US009611847B2

(12) United States Patent
Martin-Dye

(10) Patent No.: US 9,611,847 B2
(45) Date of Patent: Apr. 4, 2017

(54) AIRCRAFT MAIN ENGINE FUEL PUMP WITH MULTIPLE GEAR STAGES USING SHARED JOURNALS

(71) Applicant: Simon Martin-Dye, Avon, OH (US)

(72) Inventor: Simon Martin-Dye, Avon, OH (US)

(73) Assignee: EATON INDUSTRIAL CORPORATION, Cleveland, OH (US)

( * ) Notice: Subject to any disclaimer, the term of this patent is extended or adjusted under 35 U.S.C. 154(b) by 382 days.

(21) Appl. No.: 13/918,243

(22) Filed: Jun. 14, 2013

(65) Prior Publication Data

US 2014/0003987 A1 Jan. 2, 2014

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 11/00*** | (2006.01) |
| ***F04C 2/14*** | (2006.01) |
| ***F04C 15/00*** | (2006.01) |
| ***F04C 2/08*** | (2006.01) |
| ***F04C 2/18*** | (2006.01) |

(52) U.S. Cl.

CPC ..... *F04C 11/001* (2013.01); *F04C 2/086* (2013.01); *F04C 2/14* (2013.01); *F04C 2/18* (2013.01); *F04C 15/0023* (2013.01); *F04C 15/0026* (2013.01); *F04C 2210/1044* (2013.01); *F04C 2240/52* (2013.01); *F04C 2240/56* (2013.01)

(58) Field of Classification Search

CPC .... F04C 2/18; F04C 2/14; F04C 2/086; F04C 15/0026; F04C 15/0023; F04C 11/001; F04C 18/084; F04C 23/001; F04C 23/008; F04C 2210/1044; F04C 2240/52; F04C 2240/56

USPC ..... 418/206.1–206.7, 132, 9, 1

See application file for complete search history.

(56) References Cited

U.S. PATENT DOCUMENTS

| | | | |
|---|---|---|---|
| 3,150,593 | A | 9/1964 | Funk et al. |
| 4,245,964 | A | 1/1981 | Rannenberg |
| 4,298,319 | A | 11/1981 | Glidden |

(Continued)

FOREIGN PATENT DOCUMENTS

| | | | |
|---|---|---|---|
| EP | 0 797 002 | A1 | 9/1997 |
| EP | 1 457 678 | A1 | 9/2004 |

(Continued)

OTHER PUBLICATIONS

Machine English translation of document "AO" above—EP 1 927 753 A2—Jun. 4, 2008.

*Primary Examiner* — Theresa Trieu

(74) *Attorney, Agent, or Firm* — Fay Sharpe LLP

(57) ABSTRACT

A multistage gear pump assembly includes first and second gear pumps that use common shafts and are axially separated by a fixed spacer within the housing. Pressurized bearings are provided at opposite axial ends of the first and second gear pumps. The second gear pump handles cruise and idle operations of the aircraft while the first gear pump stage assists in meeting higher demand modes of engine operation. Otherwise, the first gear pump is maintained at a minimal pressure to reduce energy consumption and still provide desired stability and eliminate issues associated with bearing oil whirl associated with prior known arrangements. When additional assistance is required, such as during takeoff, climb, or windmill relight, the first gear pump advantageously contributes to the increased pressure.

20 Claims, 4 Drawing Sheets

(56) References Cited

U.S. PATENT DOCUMENTS

| | | | | |
|---|---|---|---|---|
| 4,330,241 | A | 5/1982 | Spurry | |
| 4,990,069 | A * | 2/1991 | Guittet | F04C 27/009 418/9 |
| 5,110,269 | A | 5/1992 | Fallon | |
| 6,309,199 | B1 * | 10/2001 | Devine | F04C 2/086 418/206.6 |
| 6,666,666 | B1 | 12/2003 | Gilbert et al. | |
| 7,497,083 | B2 | 3/2009 | Yates et al. | |
| 2004/0179953 | A1 | 9/2004 | Suzuki et al. | |
| 2005/0232784 | A1 | 10/2005 | Yates et al. | |
| 2007/0113554 | A1 | 5/2007 | Yates et al. | |

FOREIGN PATENT DOCUMENTS

| | | | |
|---|---|---|---|
| EP | 1 927 753 | A2 | 6/2008 |
| GB | 479 199 | A | 2/1938 |
| GB | 2 318 155 | A | 4/1998 |
| JP | 2001-140770 | | 5/2001 |

* cited by examiner

AIRCRAFT MAIN ENGINE FUEL PUMP WITH MULTIPLE GEAR STAGES USING SHARED JOURNALS

This application is a continuation-in-part and claims the priority benefit of U.S. application Ser. No. 12/424,745, filed Apr. 16, 2009, the disclosure of which is incorporated herein by reference.

BACKGROUND OF THE INVENTION

This disclosure relates to a multi-stage pump, and particularly to a multi-stage gear pump assembly used as a fuel pump in an aircraft gas turbine engine. It will be appreciated however, that the disclosure may find application in related environments and applications that encounter the same issues.

A large portion of aircraft engine operation involves cruise and idle situations which do not demand large quantities of fuel flow. However, certain circumstances require additional flow, for example during takeoff, climb, or windmill re-light. The fuel pump assembly must be able to satisfy both demands, while adequately addressing associated parameters such as fuel pump size, efficiency, etc. For example, it is known to employ multiple stages of a positive displacement pump assembly to meet the different needs of the aircraft engine to improve efficiency over traditional single stage gear pumps. Typically first and second stages of a multistage gear pump are selectively used. Thus, second gear pump stage is designed to handle the cruise and idle operations of the aircraft while the first gear pump stage is selectively employed in conjunction with the second stage pump to meet the higher demand modes of engine operation.

Inclusion of independent gear pumps in the same housing raises a number of issues. For example, when the second pump is functioning at maximum capacity, the first gear pump is operated at a reduced pressure state to reduce energy consumption. In the reduced pressure state, the first pump has a tendency to become unstable. As a result of the teeth of the gears transferring the relatively low load, there is resultant tooth bounce and instability, which could ultimately lead to gear tooth failure. Ideally, a full fluid film without any physical contact between the journal and the bearing surfaces is desired in the bearing assembly. This gear instability can prematurely wear the journal bearing. The bearings that support the arrangement can also become unstable when minimizing pressure to the first pump. A phenomenon known in the industry as bearing oil whirl can occur in journal bearings that are lightly loaded, which could ultimately lead to bearing failure. A conventional arrangement, for example, may drive the second gear stage through the tooth mesh of the first gear stage in order to alleviate the above issues with tooth instability and bearing oil whirl. This results in increased loading on the gear teeth of the first pump, which would require an increase in the gear teeth size or count and increasing weight for example.

There are also issues with selectively switching between single and multistage use of the pump. For instance, different forces and stresses result from different modes of operation of the multistage pump. Changing or turning the pressure on and off in connection with one of the gear pump stages has a resultant impact on the stability and efficiency of the pump assembly gears and bearings.

There is always a need to reduce the weight and overall envelope size of the pump assembly. Thus, a conventional arrangement where the first and second gear pumps are offset from one another may address a portion of the issues associated with one pump being independent of the other, but it unnecessarily adds additional components, additional wear, additional weight, and increases the overall size of the multistage pump assembly.

Accordingly, a need exists for an improved multi-stage pump assembly that addresses these needs and others in a reliable, economic manner.

SUMMARY OF THE DISCLOSURE

A multi-stage pump assembly includes a housing receiving a first gear pump. The first gear pump has a first drive journal shaft that rotates about a first axis and drives a first gear that operatively engages a second gear rotating about an adjacent second axis. A second gear pump is received in the housing and also has a first gear received on the first drive shaft in spaced relation from the first gear of the first gear pump. The first gear of the second gear pump operatively engages a second gear rotating about a second axis. A spacer is interposed between the first and second gear pumps and fixed to the housing.

The spacer extends from the housing and plate is fixed to the housing as a separate plate that is secured to the housing or as an integral part of the housing.

The first and second pumps may be differently sized, for example the first gear of the first pump may have a greater axial length than the first gear of the second pump.

A pressurized bearing arrangement supports the journal shaft, and preferably includes first and second pressurized bearing portions axially spaced from one another and supporting the common shaft of the first and second gear pumps.

In a preferred arrangement, the pump assembly includes first and second fixed bearings disposed on opposite axial sides of the fixed spacer to provide axial thrust load support to the pump assembly, and further includes first and second pressurized, floating bearings disposed on opposite sides of the first and second gear pumps.

A method of assembling a multi-stage gear pump assembly includes providing a housing and fixing a spacer in the housing, and assembling first and second gear pumps in the housing bore on opposite faces of the fixed spacer.

The method further includes providing first and second journal bearings, and preferably locating the journal bearings adjacent opposite axial ends of the housing to support the shaft. One or more gear stages can be selectively unloaded during pump operation.

The shared journal arrangement limits premature wear since the journals are always loaded and provide the needed pre-load to reduce the prospect of bearing oil whirl during periods when the first pump is unloaded, and when the discharge pressure is rapidly turned on or off.

Energy consumption is minimized during flight since one or more of the multistage gear stages can be operated at a reduced pressure loading.

By locating the gear and stages on the same journal shaft, the load can be transferred through the shaft and not through the teeth, reducing the tooth load and therefore their size.

Reduced or limited tooth bounce results from the improved stability.

Still other benefits and advantages will become more apparent to one skilled in the art upon reading and understanding the following detailed description.

DETAILED DESCRIPTION OF THE PREFERRED EMBODIMENTS

Figure 1:
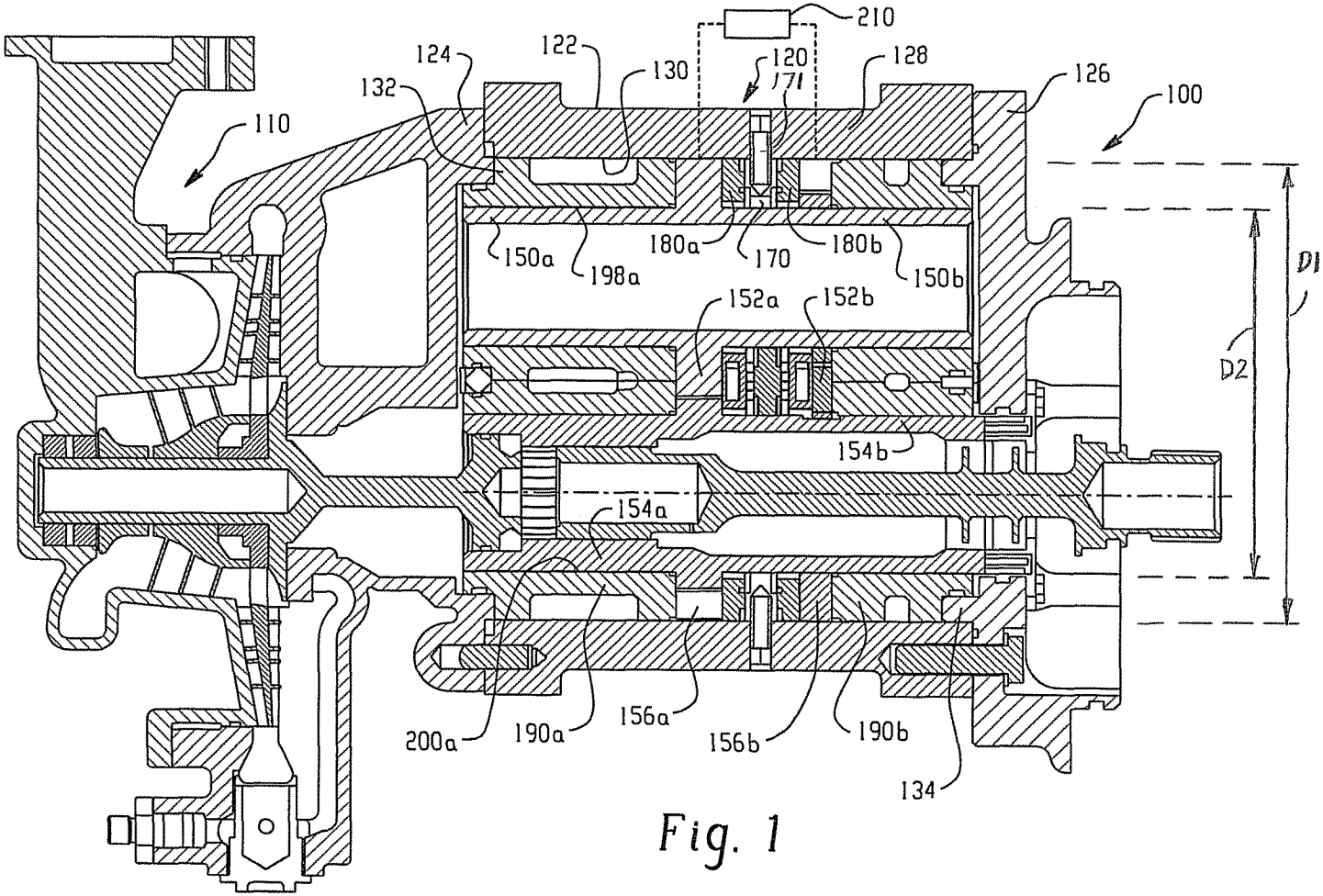
FIG. 1 is a longitudinal cross-sectional view of a portion of a fuel supply system for an aircraft engine.

Portions of a fuel supply system 100 are shown in FIG. 1 and include a low pressure centrifugal pump 110 and a multistage positive displacement pump assembly or gear pump assembly 120. In FIG. 1, the multistage pump assembly 120 includes a housing 122 having a first end portion 124, and a second end portion 126 interconnected by a central sleeve 128. The sleeve 128 is secured at opposite ends to the first and second housing end portions 124, 126, respectively. For example, fasteners secure the end portions to the ends of the sleeve. In addition, the sleeve portion 128 of the housing includes an opening such as a constant diameter bore 130 extending through the housing. In this manner, the housing portion 124 forms a first shoulder at a first end 132 and the second housing portion 126 forms a second shoulder 134 at the opposite end. Between these shoulders and along the extent of the throughbore 130 are received first and second gear pumps 140*a*, 140*b*. For purposes of brevity and ease of understanding, since the gear pumps are substantially identical, like reference numerals will refer to like components of the first and second gear pumps. Where appropriate, "a" and "b" suffixes will be used with the reference numerals to identify components associated with the first and second gear pumps, respectively. It will be further appreciated that if additional multiple stages were required, that the additional stages could adopt a structure and function substantially similar to the first and second stage gear pumps as described herein.

Figure 2:
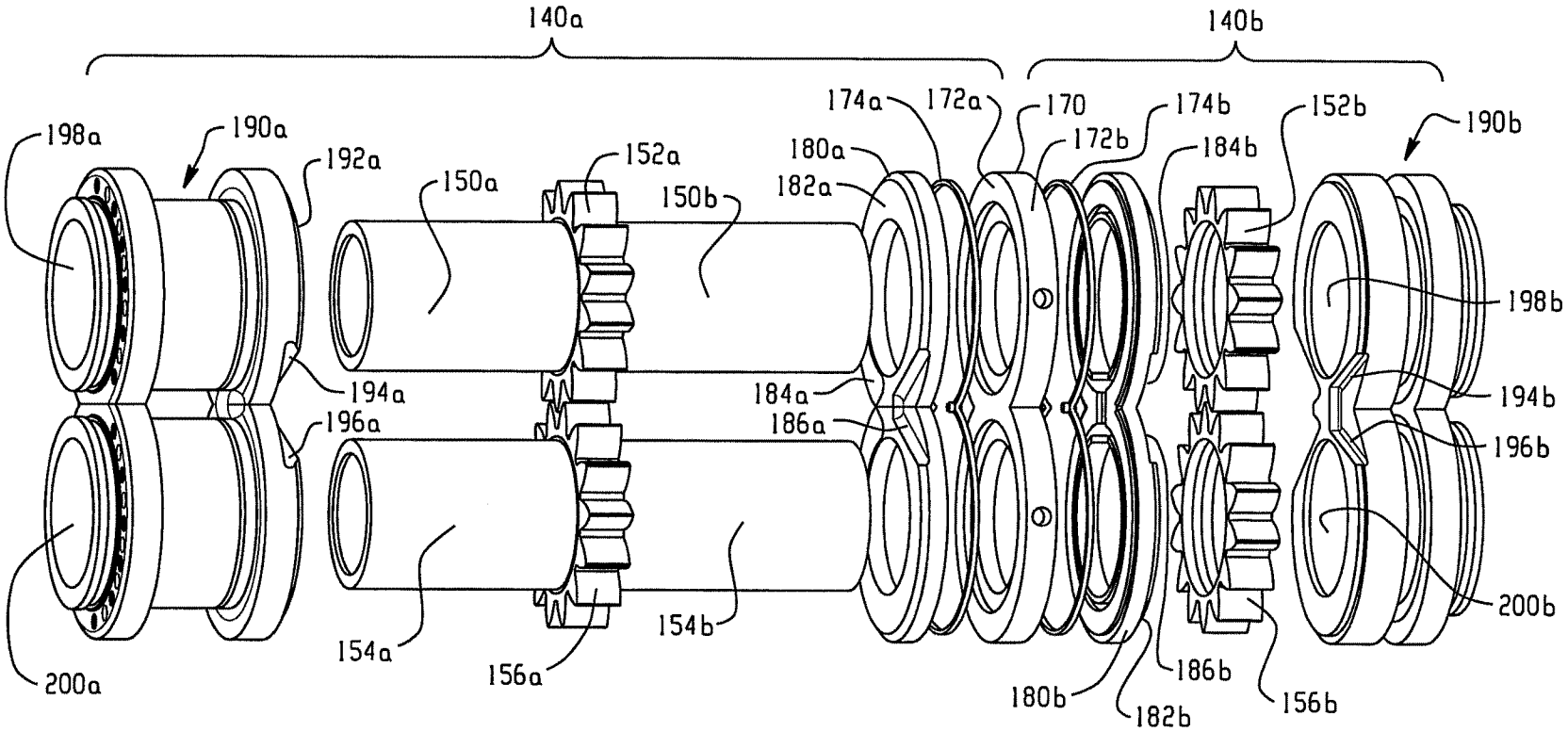
FIG. 2 is an exploded perspective view of a multi-stage gear pump assembly that includes first and second gear pumps.
Figure 3:
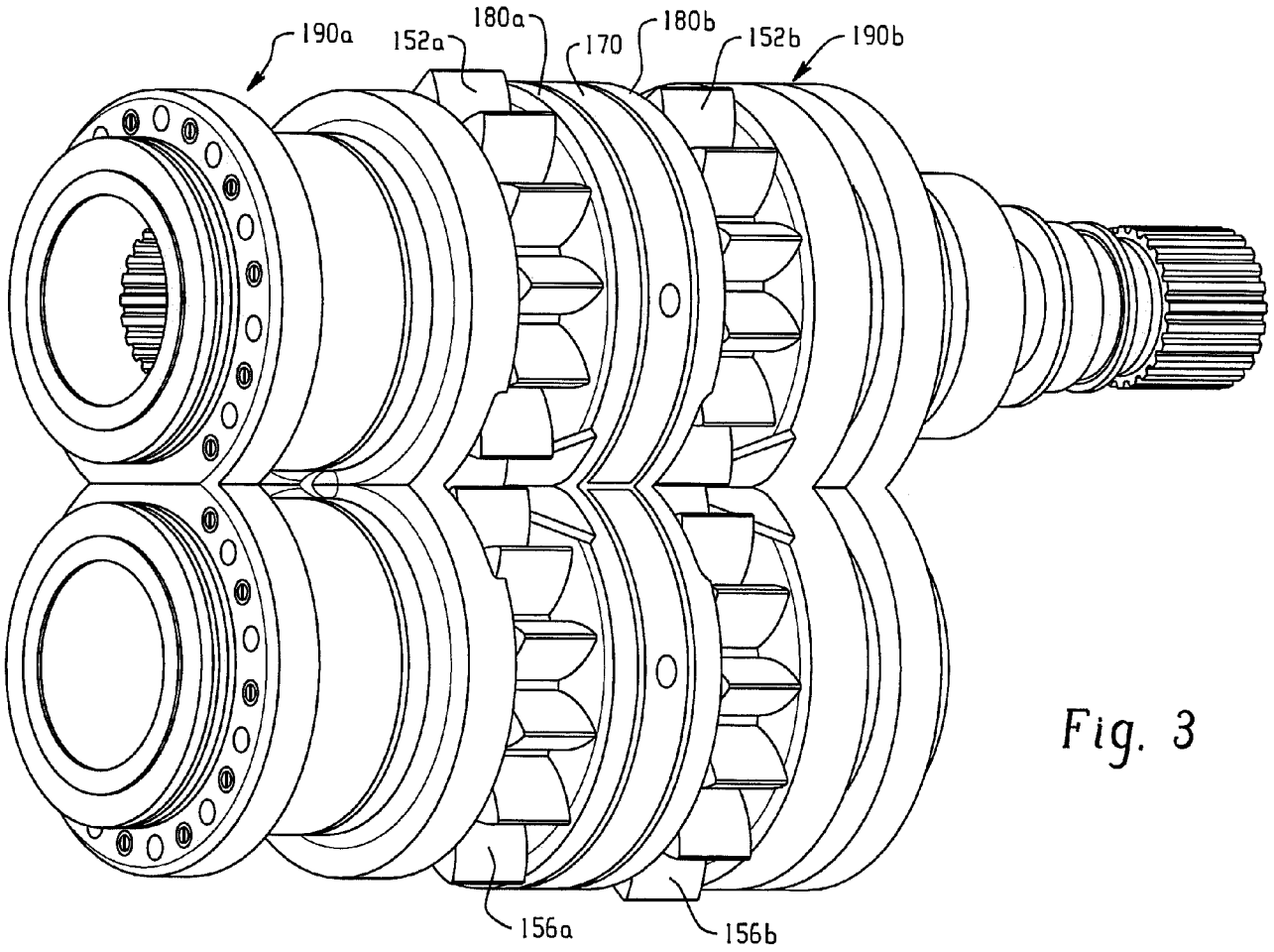
FIG. 3 is a perspective view of the assembled first and second gear pumps without the surrounding housing.

More specifically, and with continued reference to FIG. 1 and additional reference to FIGS. 2 and 3, the structure of the gear pumps will be described in greater detail. The first gear pump has a first shaft 150*a* that rotates about an associated first axis. The shaft is preferably a hollow shaft or an annular component and received on the shaft is a first gear 152*a* having multiple, circumferentially spaced teeth extending generally radially outward. The first gear 152*a* is a one-piece arrangement with the shaft in this embodiment (i.e., the first gear is integrally formed with the shaft by cutting the gear teeth about a circumferential portion at a desired axial location, or otherwise secured thereto at a predetermined axial location such as being formed as a separate annular first gear that is pinned or bolted to the shaft. A second shaft 154*a* is disposed in parallel relation to the first shaft for rotation about a second axis parallel to the first axis. A second gear 156*a* is likewise preferably a one-piece arrangement with the shaft received on the outer surface of the second shaft and the shafts are spaced a preselected dimension apart so that the gear teeth of the first and second gears 152*a*, 156*a* will mesh with one another. Thus, the second gear is secured to the second shaft in much the same manner and at the same axial location along the second shaft as the first gear is secured to the first shaft. At one end of the first gear pump is a spacer, which in this embodiment is a spacer plate 170, that is fixed at a predetermined location in the housing bore 130. The spacer plate is preferably a single piece component that is secured by one or more pins or bolts 171 (FIG. 1), or otherwise secured against axial movement within the bore. A first face 172*a* of the spacer plate faces the first and second gears 152*a*, 156*a* of the first gear pump and includes two openings therethrough that accommodate the first and second shafts, respectively. That is, the spacer plate has the general conformation of a "figure eight" (FIG. 2) with an outer periphery dimensioned for receipt in the bore 130 and the openings dimensioned to receive the shaft 150, 154 in parallel relation. Thus, the spacer plate 170 has a bore dimension D2 that is less than a housing opening dimension D1. In addition, a seal member 174*a* is interposed between the spacer plate and a fixed bearing member 180*a*. A first surface 182*a* of the fixed bearing that faces the first and second gears has recesses or channel portions 184*a*, 186*a* along mid-portions of the figure eight conformation of the fixed bearing that form one side of or portions of an inlet and outlet for fluid to reach the gear pump. Disposed on the axial opposite side of the first and second gears is a floating journal bearing assembly 190*a*. A first axial face 192*a* of the pressurized or floating bearing also includes recesses or cut-out portions 194*a*, 196*a* along mid-portions thereof that cooperate with passage portions 184*a*, 186*a* and together define the inlets and outlets to the gear pump. Inner diameter portions 198*a*, 200*a* of the pressurized bearing are closely received around the external surface of the first and second shafts 150, 154, respectively. As will be appreciated, a hydrodynamic bearing is formed between these adjacent surfaces in order to support the journal shafts during operation.

Disposed on an opposite axial end or side of the fixed spacer plate 170 is the second gear pump 140*b*. The second gear pump includes first and second gears 152*b*, 156*b* received over and fixedly secured (e.g., pinned) to respective shaft portions 150*b*, 154*b* of the first and second shafts. The radially outward extending teeth of each of the first and second gears 152*b*, 156*b* are designed for interengaging, meshing relation. As the gears rotate, the fluid is advanced or displaced by the individual teeth around the perimeter of the shaft from the inlet portions 184*b* toward the outlet portion 186*b* in the spaces between the individual teeth of the gears. In the same manner as the first gear pump, the second gear pump includes a second face 172*b* of the spacer ring that faces the first and second gears of the second gear pump. The second face 172*b* is sealed via seal member 174*b* relative to a fixed bearing member 180*b*. Again, the fixed bearing member includes portions 184*b*, 186*b*, that in conjunction with recesses 194*b*, 196*b* on the pressurized bearing 190*b*, form a respective inlet and outlet to the second gear pump. Thus, the spacer plate 170 is secured to the housing 128, and the fixed bearing portion 180*b* is sealingly engaged against the fixed spacer plate with an intermediate seal member 174*b* that also has a figure eight configuration. The spacer plate and the fixed bearings only provide axial thrust load support to the gear pump, and do not function as a journal bearing support to the shafts. The pressurized bearings 190*a*, 190*b* on the other hand, disposed on opposite sides of the first and second gear pumps and at axially outward locations of the gear pumps, are floating bearings that support the journal shafts 150, 154 via internal surface 198, 200.

The operation of each individual gear pump is generally known in the art. It will be appreciated, however, that the location and placement of the first and second gear pumps within a single diameter bore 130 in end-to-end or back-to-back relation with pressurized bearings at opposite ends is new in the art. This allows both the first and second stages to be pressurized or at least partially loaded during operation. One skilled in the art will also recognize that the spacer plate 170 and fixed bearings 180*a*, 180*b* can be one-piece as long as there is sealing between the first and second gear pump stages. Importantly, however, is a requirement that the spacer plate be axially secured or fixed and able to provide an axial thrust bearing surface. The spacer plate has to be secured axially to resist the potential axial imbalance in thrust loads when the first and second gear stages are run at different discharge pressures. Otherwise, the thrust bearing surfaces could be potentially overloaded from the mismatched pressure if the spacer plate does not adequately resist this loading.

A control or valve member is schematically shown by reference numeral 210. In this manner, and as schematically represented in FIG. 1, the second gear pump is typically used for all fuel pump operations such as takeoff, climb, cruise, idle, and windmill relight. The first gear pump, however, is only partially pressurized during the cruise and idle portions of use. That is, when additional fuel flow is demanded by the fuel system, and as required for takeoff, climb, and windmill relight, both the first and second gear pumps can be provided with full pressure. While in the cruise and idle situations, only the second gear pump output is required. The first gear pump flow will be recirculated, and is only pressurized to a partial level. In the minimized pressure state or mode of operation, the first and second bearings 190*a*, 190*b* are always loaded from operation of the pressurized second gear pump so that bearing whirl is not an issue. Moreover, there is no tooth bounce because the bearings are loaded and the load is transferred through the shared shaft 150, 154 rather than through the individual gear teeth as in prior known arrangements. Thus, whereas in the past there was an instability issue as a result of extreme pressure loads between on and off situations, such is not the case in the present arrangement.

This present arrangement eliminates another shaft and also the associated wear associated with loading the first and second gears of the first and second gear pumps on the first and second shafts, respectively. This reduces the overall weight of the gear pump assembly and reduces the envelope size for the multistage gear pump assembly. Placing the spacer plate between the first and second stages and securing the spacer plate to the housing minimizes the unbraced length of the assemblies. This arrangement increases the strength of the housing by minimizing the deflection and can reduce the weight of the housing if desired. Consequently, securing the spacer plate in the middle between the first and second gear pumps in a straight bore arrangement and sealing between the two stages to minimize cross-flow allows a longer, more flexible shaft that provides for an increased life of the pump since the shaft splines last longer as a result of a more stable arrangement. This structural arrangement also advantageously results in less cavitation and less damage to the gear pump since the loading on the gear teeth can be minimized. The single straight bore arrangement has advantages in manufacturing ease, as well as the preferred method to keep the two gear pumps on the shared shaft running as efficiently as they can with minimal flow loss.

Figure 4:
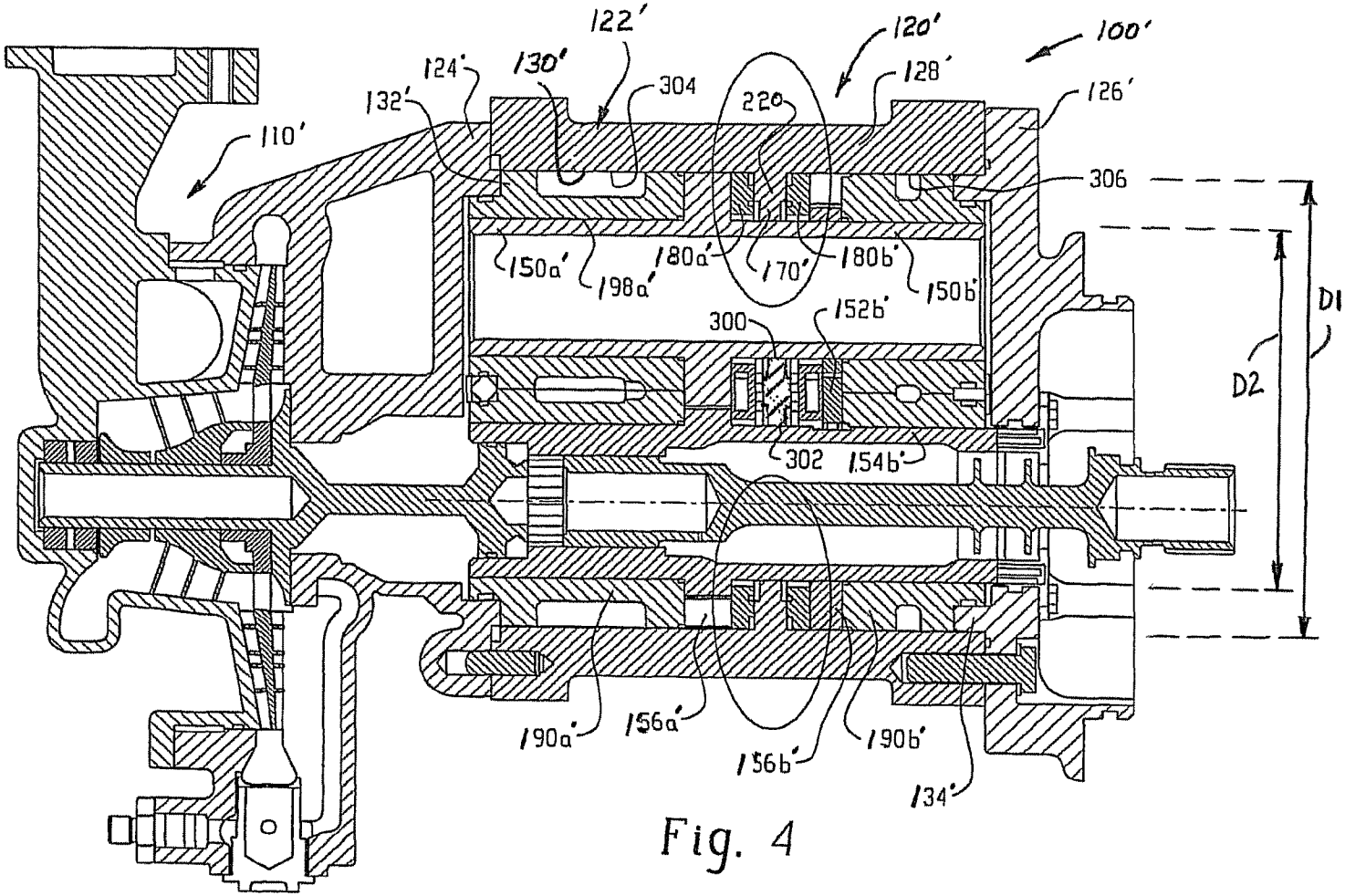
FIG. 4 is a longitudinal cross-sectional view of a second embodiment of a portion of a fuel supply system for an aircraft engine.

FIG. 4 is another embodiment that illustrates portions of a fuel supply system 200'. For ease of reference, like components are referenced by like elements with a primed suffix (e.g., fuel supply system 100 of FIGS. 1-3 is now referred to as fuel supply system 100'), while new elements are identified by new reference numerals. It is understood that if a portion of the description of system 2100' is omitted for purposes of brevity, or if a like component is not referenced by a new reference numeral, the prior description of the corresponding component(s) or system of FIGS. 1-3 still applies to the component(s) or system of FIG. 4.

More particularly, the primary modification shown in system 100' is the use of an integrated portion 220 of the housing 122' in the multistage pump assembly 120' where the integrated portion is the fixed spacer 170'. The integrated portion 220 is formed from the same material as the housing 122' so that the integrated portion serves as the fixed spacer 170'. Openings 300, 302 are formed in the fixed spacer 170' to accommodate the first and second shafts 150', 154', respectively. The same cross-hatching through the housing 122' and integrated portion 220 demonstrates that the fixed spacer 170' in this embodiment is formed by an integral portion of the housing 122'. The opening 130' in the housing 122' includes recesses or counterbores 304, 306 that extend axially inwardly from each end of the housing and terminate at the fixed spacer 170'. The spacer 170' has a bore dimension D2 that is less than the housing opening dimension D1.

The embodiment of FIG. 4, and particularly the fixed spacer 170' formed as the integrated portion 220 of the housing 122', is easily manufactured as a cast housing that undergoes separate machining or a housing that is machined to the desired final configuration. The use of the integrated portion 220 also eliminates a potential leakage path that could be present in the embodiment of FIGS. 1-3. That is, because the fixed spacer 170 in the embodiment of FIGS. 1-3 is a separate component (i.e., a plate) that is subsequently secured to the housing 122, the interface between the spacer plate and the housing could be a potential leak path. Such is not the case with the integrated portion 220 that forms the fixed spacer 170' of the embodiment of FIG. 4. There is also an associated structural improvement in the ability of the FIG. 4 embodiment to handle greater forces or stress in connection with the integrated portion 220 (presuming the same dimensional parameters are used) when compared to a separate plate that is subsequently secured to the housing as described in connection with the fixed spacer 170 of the earlier embodiment described above.

The disclosure has been described with reference to the preferred embodiment. Modifications and alterations will occur to others upon reading and understanding this specification. For example, one skilled in the art will appreciate that the gears can have different geometries, e.g., different tooth count, different diametrical pitch, different face width, etc., as long as the major diameter is the same. In fact, different geometry may assist in counteracting any potential amplification of a discharge pressure ripple from the first and second gear stages if the two gear stages were identical. It is intended to include all such modifications and alterations in so far as they come within the scope of the appended claims or the equivalents thereof.

Having thus described the invention, it is claimed:

1. A multistage gear pump assembly comprising:

a housing having an opening of a first dimension therein;

a first gear pump received in the housing having a first drive journal shaft that rotates about a first axis and drives a first gear that operatively engages a second gear rotating about an adjacent second axis for pressurizing fluid as the first and second gears mesh with one another;

a second gear pump received in the housing having a first gear received on the first drive shaft in spaced relation along the first axis from the first gear of the first gear pump, and the first gear of the second gear pump operatively engaging a second gear rotating about the second axis for pressurizing fluid as the first and second gears mesh with one another;

a spacer fixed in the housing to prevent relative movement between the spacer and the housing, the spacer includes a bore having a second dimension less than the first dimension of the housing opening such that the first dimension of the housing opening cooperates with the spacer to form first and second recesses that receive the first and second gear pumps therein on opposite ends, respectively, of the spacer and the spacer is interposed between the first and second gear pumps;

a first seal member interposed between the first and second gear pumps; and at least a first pressurized journal bearing supporting at least the first drive journal shaft.

2. The pump assembly of claim 1 wherein the first gears of the first and second pumps are different sizes.

3. The pump assembly of claim 2 wherein the first gear of the first pump has a greater axial length than the first gear of the second pump.

4. The pump assembly of claim 1 wherein the first gear of the first pump has a greater axial length than the first gear of the second pump.

5. The pump assembly of claim 1 wherein the spacer is an integral portion of the housing extending into the housing opening between the first and second gear pumps.

6. The pump assembly of claim 5 wherein the housing opening has first and second counterbores that terminate at the spacer.

7. The pump assembly of claim 1 wherein the housing opening is a bore open at first and second ends of the housing, and the spacer is a plate that is operatively secured to the housing against axial movement within the bore.

8. The pump assembly of claim 7 further comprising a second pressurized journal bearing axially spaced from the first pressurized journal bearing and supporting at least the first drive journal shaft.

9. The pump assembly of claim 8 wherein the first and second pressurized journal bearings are located axially outward of the first and second pumps, respectively.

10. The pump assembly of claim 9 wherein the second axis is parallel to the first axis, and the second gears of the first and second pumps are secured to a second shaft that rotates about the second axis.

11. The pump assembly of claim 1 further comprising first and second bearings disposed on opposite axial sides of the spacer to provide axial thrust load support.

12. The pump assembly of claim 11 further comprising first and second seals interposed between the spacer and the first and second bearings, respectively.

13. A multistage gear pump assembly comprising:

a housing having a bore of constant diameter therein;

a first gear pump received in the bore having a first drive journal shaft that rotates about a first axis and drives a first gear that operatively engages a second gear rotating about an adjacent second axis for pressurizing fluid as the first and second gears mesh with one another;

a second gear pump received in the bore having a first gear received on the first drive shaft in spaced relation along the first axis from the first gear of the first gear pump, and the first gear of the second gear pump operatively engaging a second gear rotating about the second axis for pressurizing fluid as the first and second gears mesh with one another;

a spacer plate received in the bore and interposed between the first and second gear pumps in the bore;

a member operatively securing the spacer plate against axial movement within the bore; and at least a first pressurized journal bearing supporting at least the first drive journal shaft.

14. A method of assembling a multistage gear pump assembly comprising:

forming an opening having a first dimension in a housing;

fixing a spacer, having a bore of a second dimension less than the first dimension of the housing opening, in the housing against axial movement relative to the housing and thereby defining first and second recesses on opposite ends, respectively, of the spacer;

assembling first and second gear pumps in the recesses on opposite faces of the spacer;

providing a first seal member interposed between the spacer and the first pump; and providing first and second pressurized journal bearings in the housing.

15. The method of claim 14 further comprising locating the journal bearings at opposite axial ends of the housing to support the shaft.

16. The method of claim 14 further comprising providing a second seal member interposed between the spacer and the second gear pump.

17. The method of claim 14 wherein the fixing step includes forming the spacer as an integral portion of the housing that is interposed between the first and second gear pumps to provide axial thrust load support to the gear pumps.

18. The method of claim 14 wherein the fixing step including providing a separate spacer plate and securing the spacer plate to the housing.

19. The pump assembly of claim 1 wherein the first seal member is interposed between the first gear pump and the spacer.

20. The pump assembly of claim 19 further comprising a second seal member interposed between the second gear pump and the spacer.

* * * * *